United States Patent [19]

Blomberg

[11] Patent Number: 5,016,225

[45] Date of Patent: May 14, 1991

[54] TRANSDUCER MOUNTING BRACKET

[76] Inventor: Merril Blomberg, 6746 190th La., N.W., Anoka, Minn. 55303

[21] Appl. No.: 434,354

[22] Filed: Nov. 13, 1989

[51] Int. Cl.[5] ..... H04R 15/00

[52] U.S. Cl. ..... 367/173; 248/59; 248/205.5

[58] Field of Search ..... 367/141, 173, 177, 178, 367/188; 248/59, 61, 62, 63, 71, 74.1, 206.4, 231.9, 214, 205.5, 206.2

[56] References Cited

U.S. PATENT DOCUMENTS

| | | | |
|---|---|---|---|
| 3,729,162 | 4/1973 | Salvato | 367/173 |
| 3,740,706 | 6/1973 | Joseph | 367/173 |
| 3,752,431 | 8/1973 | McBride | 367/173 |
| 4,152,690 | 5/1979 | Veatch | 367/173 |
| 4,282,590 | 8/1981 | Wingate | 367/173 |
| 4,285,485 | 8/1981 | Burke | 367/173 |
| 4,811,310 | 3/1989 | Wille | 367/173 |
| 4,928,915 | 5/1990 | Mavins | 367/173 |

*Primary Examiner*—Brian S. Steinberger
*Attorney, Agent, or Firm*—Jerry T. Kearns

[57] ABSTRACT

A transducer mounting bracket for mounting a sonar transducer of a fish locator on a boat transom has an elongated base formed from a thermoplastic resilient material and including a downwardly opening channel formed at an upper end dimensioned for engagement with a boat transom. An elongated conduit extends along a front face of the base and is secured for vertical adjustment within a pair of vertically spaced aligned mounting blocks. Thumb screws extend through each of the mounting blocks for clamping engagement with the conduit. An L-shaped bracket has a vertical leg portion secured at a lower end of the conduit and a horizontal leg secured to a solenoid transducer. A signal lead connected to the transducer extends through the interior of the conduit. In a second embodiment, the transducer mounting bracket includes a V-shaped weed deflector for preventing weeds from collecting on the transducer, a flexible boot provided on a top end of the conduit and in sealing relation with the transducer signal lead, and a pair of suction cup tipped clamping screws extending through the base for engagement with a boat transom.

1 Claim, 3 Drawing Sheets

TRANSDUCER MOUNTING BRACKET

BACKGROUND OF THE INVENTION

1. Field of the Invention

The present invention relates to mounting brackets, and more particularly pertains to a mounting bracket specifically designed for mounting a sonar transducer of a fish finding system on a boat transom. Conventional transducer mounting brackets utilize a rubber suction cup for engagement with a boat transom. The suction cup provides an inadequate securing force and as a result the transducer is frequently dislodged. In order to overcome this problem, the present invention provides an improved transducer mounting bracket for mounting a solenoid transducer on a boat transom in a vertically adjustable secure manner, without scratches or other damage to the exterior of a boat.

2. Description of the Prior Art

Various types of mounting brackets are known in the prior art. A typical example of such a mounting bracket is to be found in U.S. Pat. No. 3,740,706, which issued to S. Joseph on June 19, 1973. This patent discloses a transducer mounting device for mounting a marine hydrophone transducer on a boat. An elongated boom has one end adapted for carrying the transducer for extension into the water. The boom is pivotally connected to a base mounted on the deck of the boat for pivoting movement between a retracted position with the boom out of the water and an extended position with the boom positioning the transducer below the surface of the water. U.S. Pat. No. 3,752,431, which issued to W. McBride on Aug. 14, 1973, discloses a transducer mounting bracket for mounting a solenoid transducer on a boat transom including a pair of brackets mounted at vertically spaced locations on the boat transom. A threaded shaft is manually adjustable to orient a pivotal transducer mounting bracket. U.S. Pat. No. 4,152,690, which issued to D. Veatch on May 1, 1979, discloses a flexible transducer mount to allow a transducer to be moved about beneath the water and thereby scan in more than one direction. The device includes a flexible control cable secured to a control lever mounted within the boat. The transducer is pivotally mounted such that the action of the control cable pivots the transducer in a vertical plane. U.S. Pat. No. 4,282,590, which issued to K. Wingate on Aug. 4, 1981, discloses an adjustable mounting bracket for a sonar transducer which includes a threaded shaft for vertically and pivotally adjusting the position of a sonar transducer. U.S. Pat. No. 4,285,485, which issued to W. Burke on Aug. 25, 1981, discloses a retractable sonar mounting bracket having a sonar transducer carried at the end of an elongated rod which is secured by a set screw within a cylindrical sleeve on a pivotal mounting plate. The mounting plate includes a detent mechanism for securing the transducer in a selected angular orientation.

While the above mentioned devices are directed to transducer mounting brackets, none of these devices disclose a transducer mounting bracket including an elongated base formed from a thermoplastic material and having a downwardly opening channel for non-marring frictional engagement over a boat transom. Additional features of the present invention, not contemplated by the aforementioned prior art devices include the provision of a weed deflector and the use of a flexible sealing boot to locate a sonar control lead within an elongated vertically adjustable conduit. Inasmuch as the art is relatively crowded with respect to these various types of mounting brackets, it can be appreciated that there is a continuing need for and interest in improvements to such mounting brackets, and in this respect, the present invention addresses this need and interest.

SUMMARY OF THE INVENTION

In view of the foregoing disadvantages inherent in the known types of mounting brackets now present in the prior art, the present invention provides an improved transducer mounting bracket. As such, the general purpose of the present invention, which will be described subsequently in greater detail, is to provide a new and improved transducer mounting bracket which has all the advantages of the prior art mounting brackets and none of the disadvantages.

To attain this, representative embodiments of the concepts of the present invention are illustrated in the drawings and make use of a transducer mounting bracket, for mounting a sonar transducer of a fish locator on a boat transom, which has an elongated base formed from a thermoplastic resilient material and including a downwardly opening channel formed at an upper end dimensioned for engagement with a boat transom. An elongated conduit extends along a front face of the base and is secured for vertical adjustment within a pair of vertically spaced aligned mounting blocks. Thumb screws extend through each of the mounting blocks for clamping engagement with the conduit. An L-shaped bracket has a vertical leg portion secured at a lower end of the conduit and a horizontal leg secured to a solenoid transducer. A signal lead connected to the transducer extends through the interior of the conduit. In a second embodiment, the transducer mounting bracket includes a V-shaped weed deflector for preventing weeds from collecting on the transducer, a flexible boot provided on a top end of the conduit and in sealing relation with the transducer signal lead, and a pair of suction cup tipped clamping screws extending through the base for engagement with a boat transom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved transducer mounting bracket which has all the advantages of the prior art mounting brackets and none of the disadvantages.

It is another object of the present invention to provide a new and improved transducer mounting bracket which may be easily and efficiently manufactured and marketed.

It is a further object of the present invention to provide a new and improved transducer mounting bracket which is of a durable and reliable construction.

An even further object of the present invention is to provide a new and improved transducer mounting bracket which is susceptible of a low cost of manufacture with regard to both materials and labor, and which accordingly is then susceptible of low prices of sale to the consuming public, thereby making such mounting brackets economically available to the buying public.

Still yet another object of the present invention is to provide a new and improved transducer mounting bracket which provides in the apparatuses and methods of the prior art some of the advantages thereof, while simultaneously overcoming some of the disadvantages normally associated therewith.

Still another object of the present invention is to provide a new and improved transducer mounting bracket for mounting the transducer of a sonar fish locating system on a boat transom.

Yet another object of the present invention is to provide a new and improved transducer mounting bracket for mounting the sonar transducer of a fish locating system on a boat transom, without requiring the use of any clamping screws and thus precluding damage to the boat surface.

Even still another object of the present invention is to provide a new and improved transducer mounting bracket for securing a sonar transducer for selected vertical adjustment on the transom of a boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
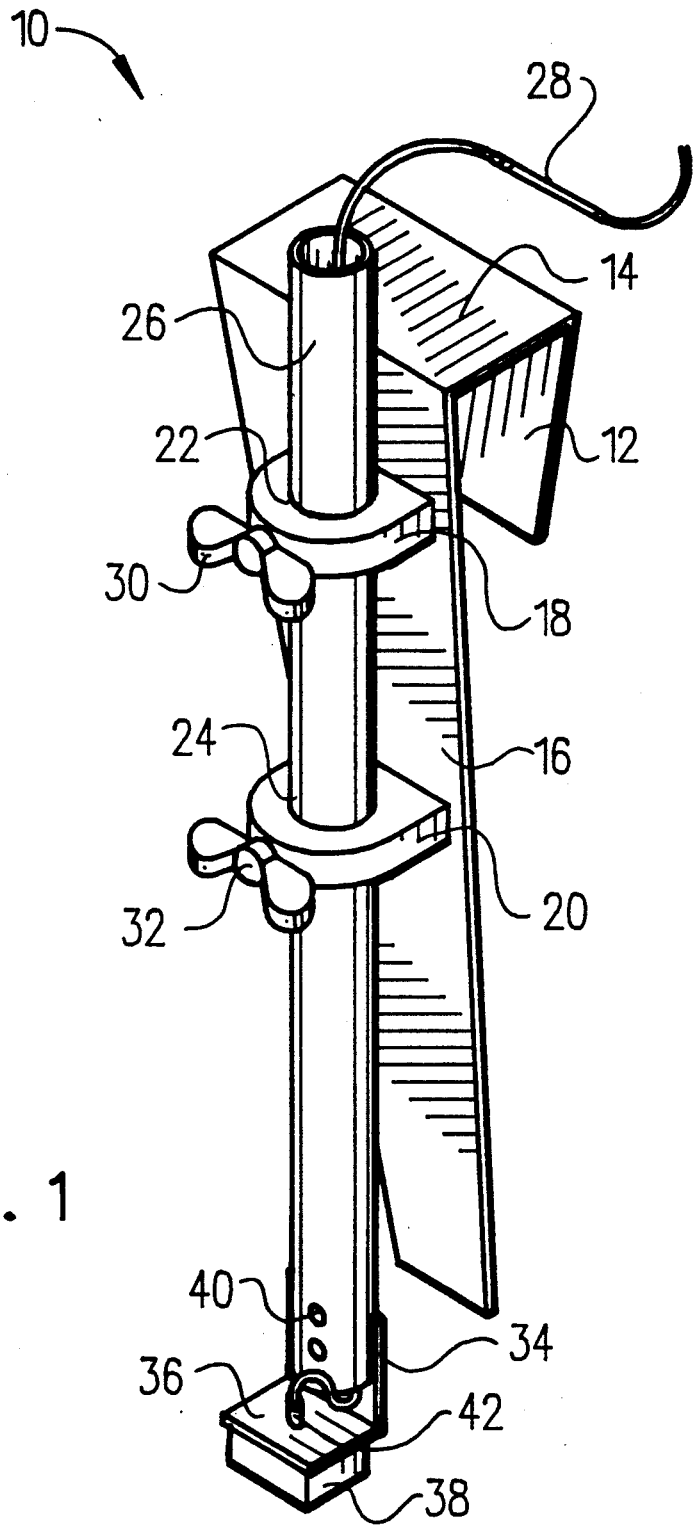
FIG. 1 is a perspective view of the transducer mounting bracket according to a first embodiment of the present invention.

With reference now to the drawings, and in particular to FIG. 1 thereof, a new and improved transducer mounting bracket embodying the principles and concepts of the present invention and generally designated by the reference numeral 10 will be described.

More specifically, it will be noted that the first embodiment 10 of the invention includes an elongated planar base 16 having a generally trapezoidal configuration. A right angle flange 14 is formed at a top end of the base 16 and is connected to a second downwardly extending obliquely angled flange 12. The flanges 12 and 14 form a downwardly opening channel at an upper end of the base 16 which is dimensioned for frictional engagement over the top edge of a boat transom. The base 16 and flanges 12 and 14 are preferably formed from a resilient thermoplastic material which may be elastically deformed within a predetermined dimensional range for adaptation with boat transoms of various different thicknesses. The transducer mounting bracket 10 may thus be secured and removed quickly on a boat transom, without requiring the use of any tools or threaded fasteners which can potentially damage the exterior finish on the boat transom. A pair of mounting blocks 18 and 20 are secured at vertically spaced aligned positions along the front face of the base 16 and include respective aligned circular apertures 22 and 24 which receive a hollow cylindrical conduit 26. The signal lead 28 from a sonar fish finding system extends through the hollow interior of the conduit 26 and terminates in a connection 42 with a sonar transducer 38. An L-shaped transducer mounting bracket is secured bY one or a plurality of rivets or threaded fasteners 40 at a bottom end of the conduit 26. A first vertical leg portion 34 is preferably received through a vertical slot formed in the end of the conduit 26. A horizontal leg portion 36 is secured to the transducer 38. The conduit 26 is received for vertical sliding movement within the mounting blocks 18 and 20 and is secured in a selected vertically adjusted position by tightening thumb screws 30 and 32 into frictional engagement with an outer surface of the conduit 26.

Figure 2:
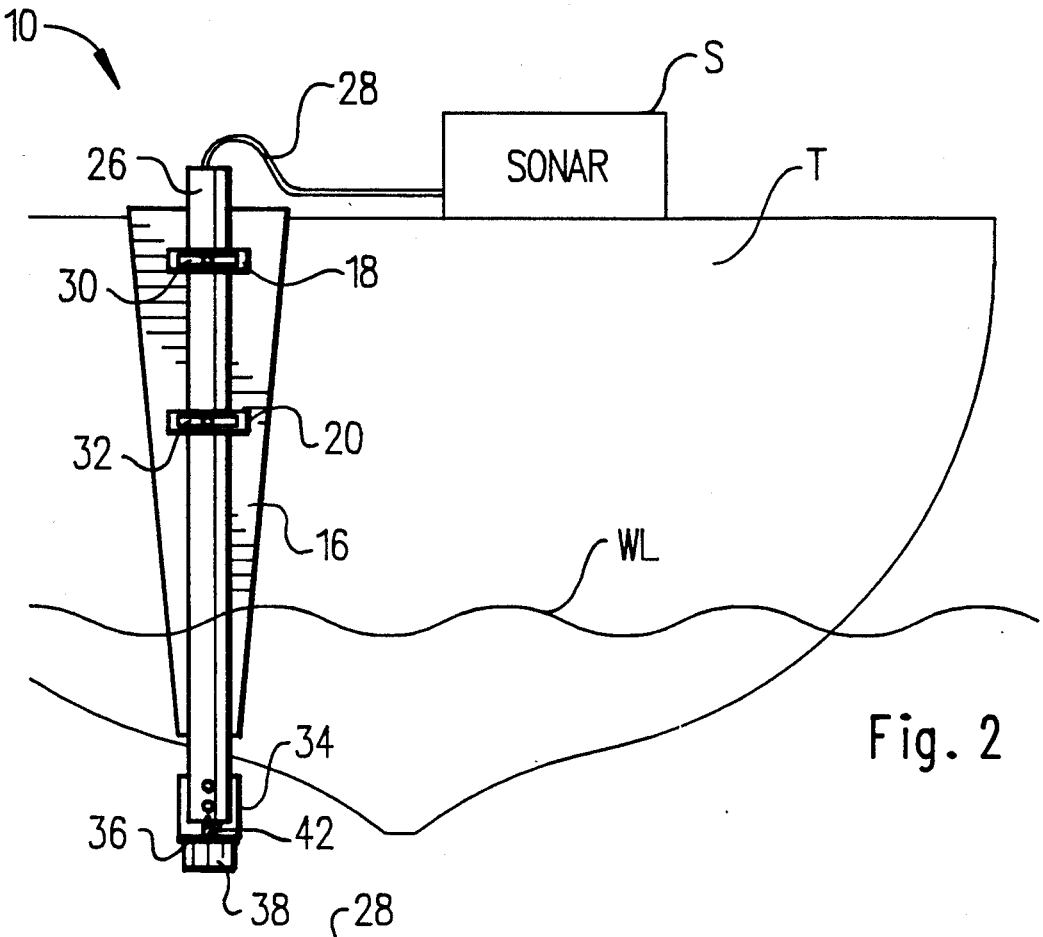
FIG. 2 is a diagrammatic end view illustrating the transducer mounting bracket of FIG. 1 installed on the transom of a boat.

FIG. 2 illustrates the transducer mounting bracket 10 installed on a transom T of a boat. The signal lead 28 from the sonar system S is operatively connected to the transducer 38 through the interior of the conduit 26. The transducer 38 is disposed below the water line WL, slightly below the bottom surface of the boat.

Figure 3:
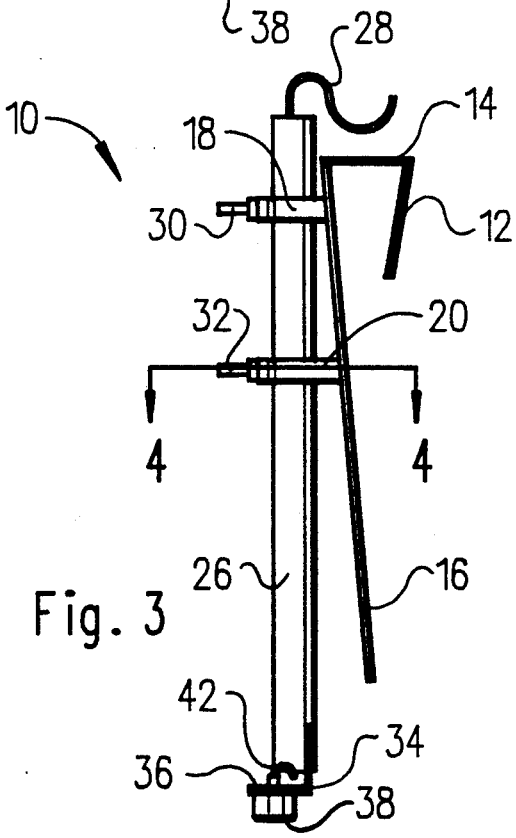
FIG. 3 is a side view illustrating the transducer mounting bracket of FIG. 1.

FIG. 3 illustrates a side view of the transducer mounting bracket 10.

Figure 4:
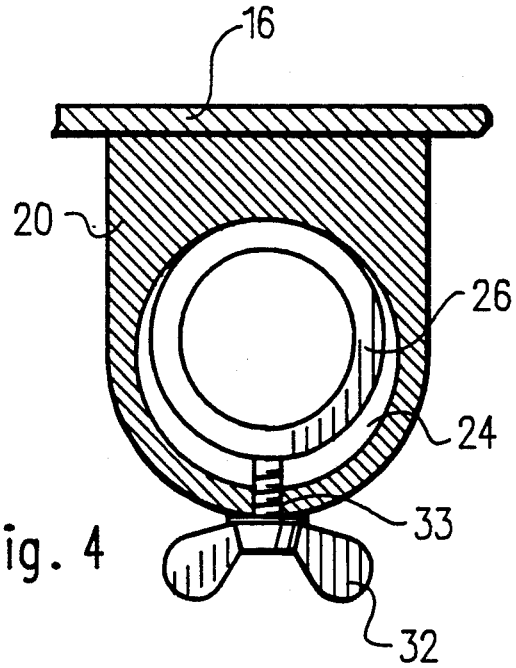
FIG. 4 is a cross sectional view illustrating the clamping mechanism for securing the transducer in an adjusted vertical position.

As shown in the cross sectional view of FIG. 4, the conduit 26 extends through the circular aperture 24 formed through the mounting block 20 and is clamped in position by frictional engagement with a thumb screw 32 which is received through a transverse threaded aperture 33, which communicates with the circular aperture 24. It should be understood that the mounting block 18 and thumb screw 30 are identically constructed.

Figure 5:
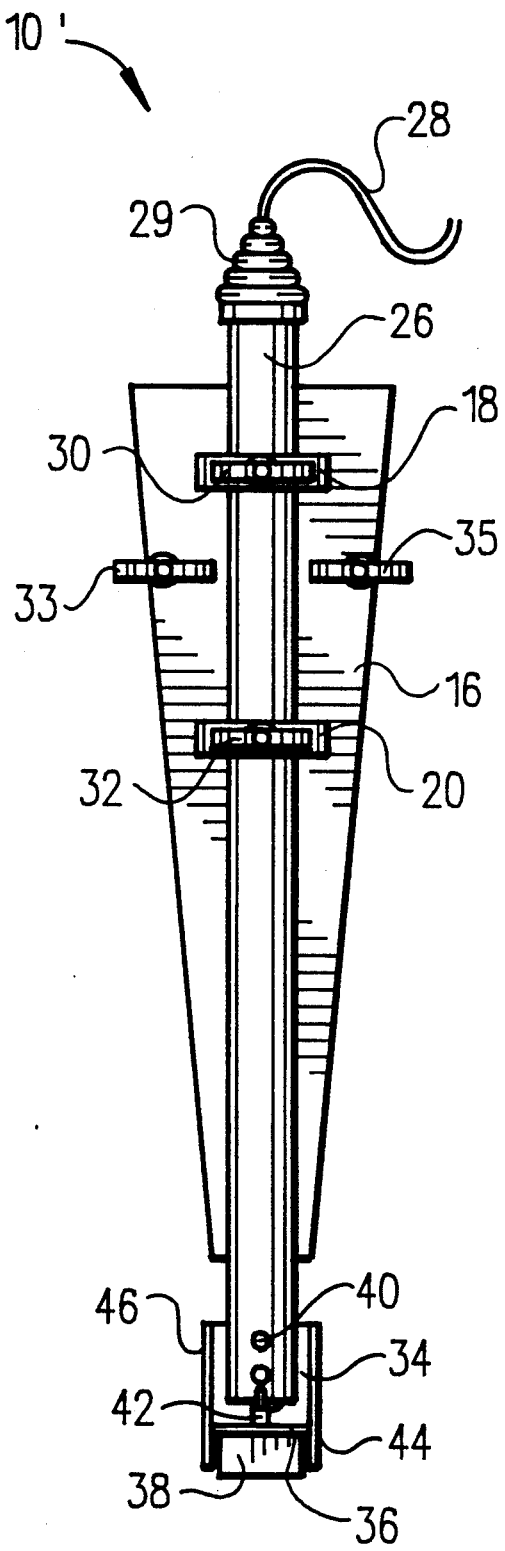
FIG. 5 is an end view illustrating a transducer mounting bracket according to a second embodiment of the present invention.

FIG. 5 illustrates a transducer mounting bracket 10' according to a second embodiment of the present invention. The transducer mounting bracket 10' is similarly formed as described previously with respect to the first embodiment 10 illustrated in FIGS. 1 through 4, with the following additional features. A resilient flexible sealing boot 29 is provided over an upper end of the conduit 26 and receives the transducer lead 28 in sealing engagement. This prevents abrasion of the lead 28 on the upper edge of the conduit 26 and prevents foreign materials from contaminating the interior of the conduit 26. A pair of thumb screws 33 and 35 extend transversely through the base 16 and are each tipped with a resilient suction cup foot member for engagement with the outer face of a boat transom.

Figure 6:
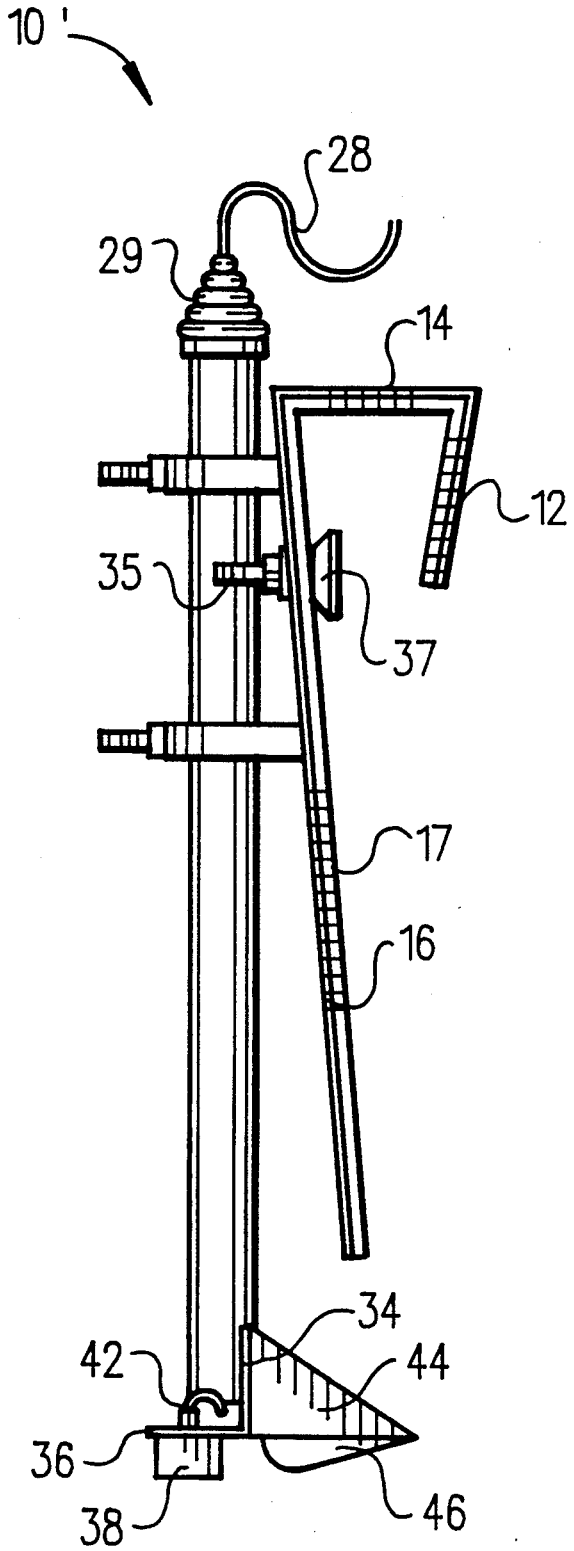
FIG. 6 is a side view illustrating the transducer mounting bracket of FIG. 5.

As shown in the side view of FIG. 6, the base 16, and flanges 12 and 14 are formed from a deformed sheet metal material and are aligned with an abrasion resistant resilient material 17 such as rubber or a resilient plastic. This prevents damage to the surface finish of the boat. A generally V-shaped weed deflector includes opposite side portions 44 and 46 which are secured to opposite side portions of the vertical leg 34 of the transducer L-shaped mounting bracket. The weed deflector serves as a guard to prevent fouling of the transducer and signal lead with aquatic vegetation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A transducer mounting bracket, comprising:

an elongated base formed from sheet metal lined with a resilient material for frictional engagement with a boat transom;

a downwardly opening channel formed at an upper end of said base for frictional engagement with a boat transom, said channel tapering in width from a widest portion adjacent said upper end;

an elongated conduit extending along a front face of said base;

a pair of spaced mounting blocks secured in vertical spaced aligned locations on said front face of said base;

a lower one of said mounting blocks projecting laterally from said base an extent sufficient to dispose said conduit in a vertical orientation;

aligned circular apertures formed through said mounting blocks and receiving said conduit;

a thumb screw extending through each of said mounting blocks for clamping engagement with said conduit, securing said conduit on said base for vertical adjustment with respect to said base;

an L-shaped bracket having a vertical leg portion secured to said conduit and a horizontal leg portion secured to a sonar transducer for securing the sonar transducer at a bottom end of said conduit;

at least one suction cup tipped clamping screw extending transversely through said base for engagement with a boat transom a signal lead from said transducer extending through said conduit and sealed at a top portion of said conduit by a flexible boot; and a generally V-shaped weed deflector on said vertical leg portion of said L-shaped bracket, said weed deflector having a central apex line formed by intersecting triangular side faces, said apex line lying in a plane containing a central longitudinal axis of said conduit, a pointed tip portion of said weed deflector directed toward said transom.

* * * * *